United States Patent [19]

Anderson

[11] Patent Number: 4,722,463

[45] Date of Patent: Feb. 2, 1988

[54] FLUID DISPENSING APPARATUS

[76] Inventor: Jerry L. Anderson, 2206 Sunwood, San Antonio, Tex. 78232

[21] Appl. No.: 907,050

[22] Filed: Sep. 12, 1986

[51] Int. Cl.[4] ..... B67D 3/00

[52] U.S. Cl. ..... 222/185; 222/481.5; 222/484; 222/509; 251/245; 137/588

[58] Field of Search ..... 251/245; 137/588, 594, 137/625.18; 222/173, 180–181, 185, 464, 478–479, 481–483, 484, 509, 518, 525, 545–546

[56] References Cited

U.S. PATENT DOCUMENTS

| | | | |
|---|---|---|---|
| 737,767 | 9/1903 | Pigrenet | 137/588 |
| 1,017,756 | 2/1912 | Head | 222/185 X |
| 2,264,671 | 12/1941 | Kocher | 137/588 X |
| 2,405,681 | 8/1946 | Woock | 222/484 X |
| 3,052,386 | 9/1962 | Martorelli | 222/545 X |
| 3,178,062 | 4/1965 | Welty et al. | 222/509 X |
| 3,376,582 | 4/1968 | Samuels | 222/509 X |
| 3,417,962 | 12/1968 | Fuerst | 222/509 X |
| 4,260,074 | 4/1981 | Cerrato | 222/481.5 X |

*Primary Examiner*—Joseph J. Rolla
*Assistant Examiner*—Michael S. Huppert
*Attorney, Agent, or Firm*—Cox & Smith Inc.

[57] ABSTRACT

An apparatus for dispensing fluids from a bottle comprising a housing having a bore extending through the housing and a connector for releasably securing the housing to the mouth of a bottle containing fluid. A spool received within the bore of the housing is selectively positionable in a first, closed position and in a second, open position. The spool is provided with passageways therethrough for passage of air and the housing is provided with an inlet port, spout, and an annular groove for passage of fluids therethrough. In the second, open position fluid flows through the passageways and the annular groove of the spool out of bottle, and air flows through the passageways and the annular recess of the bore into the bottle.

27 Claims, 5 Drawing Figures

FLUID DISPENSING APPARATUS

BACKGROUND OF THE INVENTION

The present invention relates to an apparatus for dispensing fluids from a bottle. More particularly, the present invention relates to an apparatus for replacing the resealable cap of a bottle, particularly of the screw-on type, which allows a fluid contained therein to be selectively dispensed from the bottle without removing the apparatus from the bottle as is required to dispense the fluid from a bottle sealed by such a releasable cap.

Since the advent of the plastic bottle for the bottling of carbonated soft drinks, wine coolers, juice drinks, and other refreshing liquids, it is now feasible to market these liquid drinks in much larger amounts than could be sold in glass bottles without the risk of breakage or excessive weight in shipping. The term "bottle" as used herein refers to any container for containing a fluid having an opening of narrow diameter. However, it will be understood by those skilled in the art who have the benefit of this disclosure that the present invention has particular utility for use with bottles containing such liquids.

Two-, three-, and four-liter plastic and glass bottles having screw tops are now commercially available for the convenience of manufacturers, distributors, and consumers. In actual use in the home, however, those soft-drink bottles are sometimes unwieldy and much too heavy for easy storage and serving. A two-liter bottle barely fits into a standard refrigerator door shelf. A three-liter bottle must be placed on a very deep refrigerator shelf to be stored in a refrigerator. A relatively strong adult is required to lift and pour from a three-liter bottle. Small children and older or enfeebled adults simply cannot serve themselves a portion of liquid from a three-liter or larger bottle because of the weight and dimensions of the bottle.

Another problem with such large bottles is that they are commonly used as containers for carbonated beverages. The constant tipping, agitation, opening and closing of the bottle causes the loss of the carbonation. Accordingly, a need has arisen for an apparatus for retaining a large bottle on a refrigerator shelf or in another location for dispensing desired amounts of a carbonated beverage or other liquid from the bottle.

It is an object of the present invention to provide an apparatus for retaining large bottles thereon, and for dispensing desired amounts of liquid from such a bottle without dissipating the carbonation of the beverage enclosed in the bottle.

It is another object of the present invention to provide a portable dispensing unit having a dispensing apparatus which can be quickly and easily secured to the mouth of a carbonated beverage bottle or other fluid containing bottle, and a support stand within which the bottle can be quickly and conveniently secured.

A further object of the present invention is to provide a dispensing mechanism and support apparatus for plastic beverage bottles which is adaptable for use with any of the commercially available sizes of plastic beverage bottles for storage and serving.

These and other objects, features, and advantages of the invention will become apparent to those skilled in the art in the light of the following detailed description, viewed in conjunction with the referenced drawings, of a preferred beverage dispensing apparatus according to the invention. The foregoing and following description of the invention is for exemplary purposes only. The true spirit and scope of the invention is set forth in the appended claims.

SUMMARY OF THE INVENTION

An apparatus for dispensing fluids from a bottle comprising a housing having an axially extending bore therethrough and means for releasably closing a bottle containing fluid therein. A cylindrical spool is slidably received within the axially extending bore of the housing and selectively positionable in a first closed position or a second open position, and means is provided for biasing the spool toward the first closed position. The spool is provided with an annular groove, and the housing is provided with an inlet port through the wall of the portion of the housing contained within the bottle, the inlet port being continuous with the axially extending bore. The housing is also provided with a spout through the wall of the portion of the housing outside of the bottle which is continuous with the axially extending bore therethrough. The spool is provided with a first passageway having a first opening at the first end of the spool and a second opening in the side wall of the spool; and a second passageway having a first opening at the second end of the spool and a second opening in the side wall of the spool in close proximity to the second opening of the first passageway. An annular recess is formed in the axially extending bore through the housing, and when the spool is in the second open position the first and second passageways and the annular recess are continuous and the inlet port, spout and annular groove are continuous.

DETAILED DESCRIPTION OF THE DRAWINGS

Figure 1:
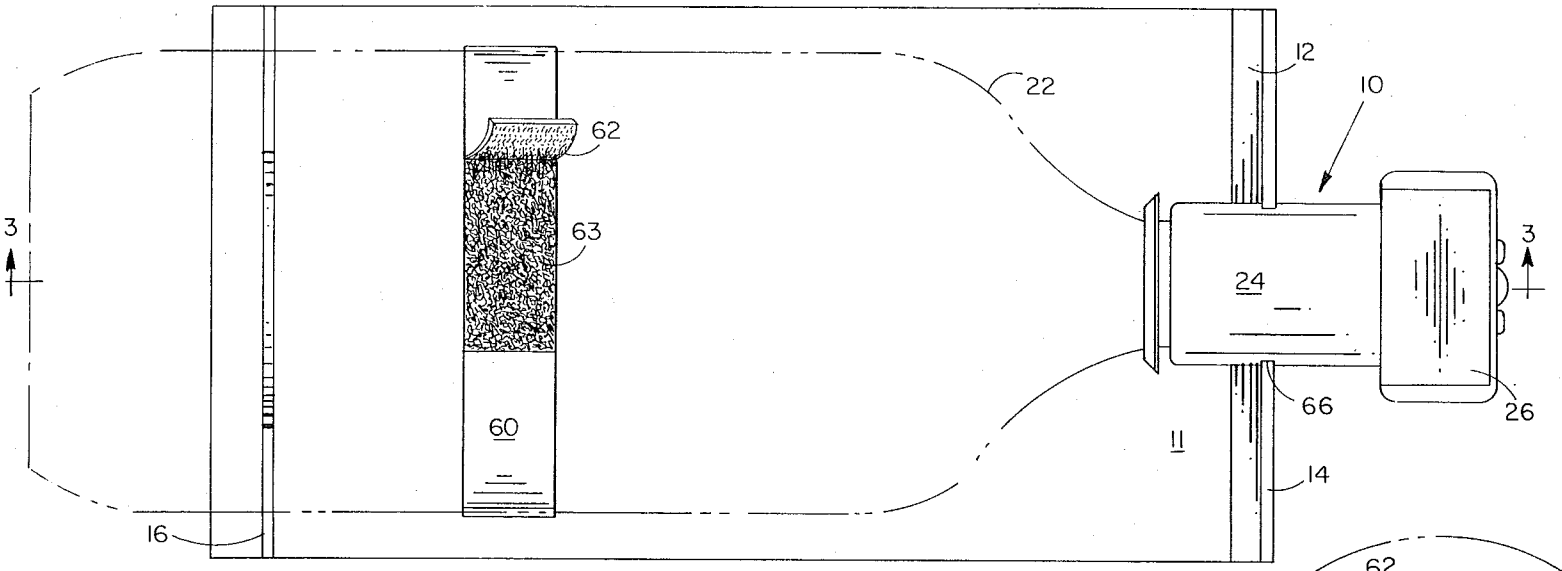
FIG. 1 is a plan view of a beverage dispensing apparatus constructed according to the teachings of the present invention.
Figure 2:
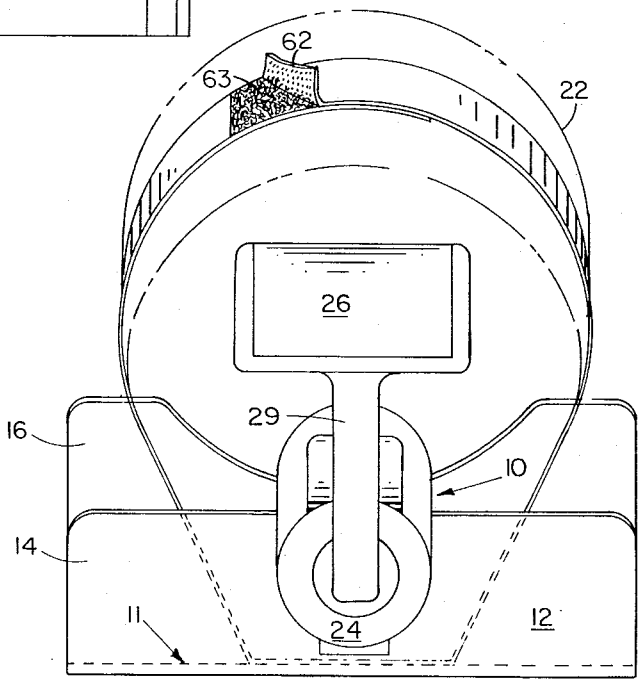
FIG. 2 is a front view of the apparatus of the present invention.

A presently preferred embodiment of an apparatus for dispensing fluids according to the present invention is designated generally at reference numeral 10 in FIG. 1. The apparatus 10 for dispensing fluids 21 from a bottle 22 comprises a housing 24 having an axially extending bore 33 therethrough and means for releasably closing bottle 22 containing a fluid 21 therein. In a presently preferred embodiment, the means for releasably closing bottle 22 is threads 27 (see FIGS. 3 and 4) integrally formed in housing 24 for screwing the housing 24 onto and off of the screw-top mouth (not numbered) of, for instance, a plastic beverage bottle 22. The housing 24 can also be constructed having a snap-on engagement means (not shown) for use with bottles not having screw-caps.

Figure 3:
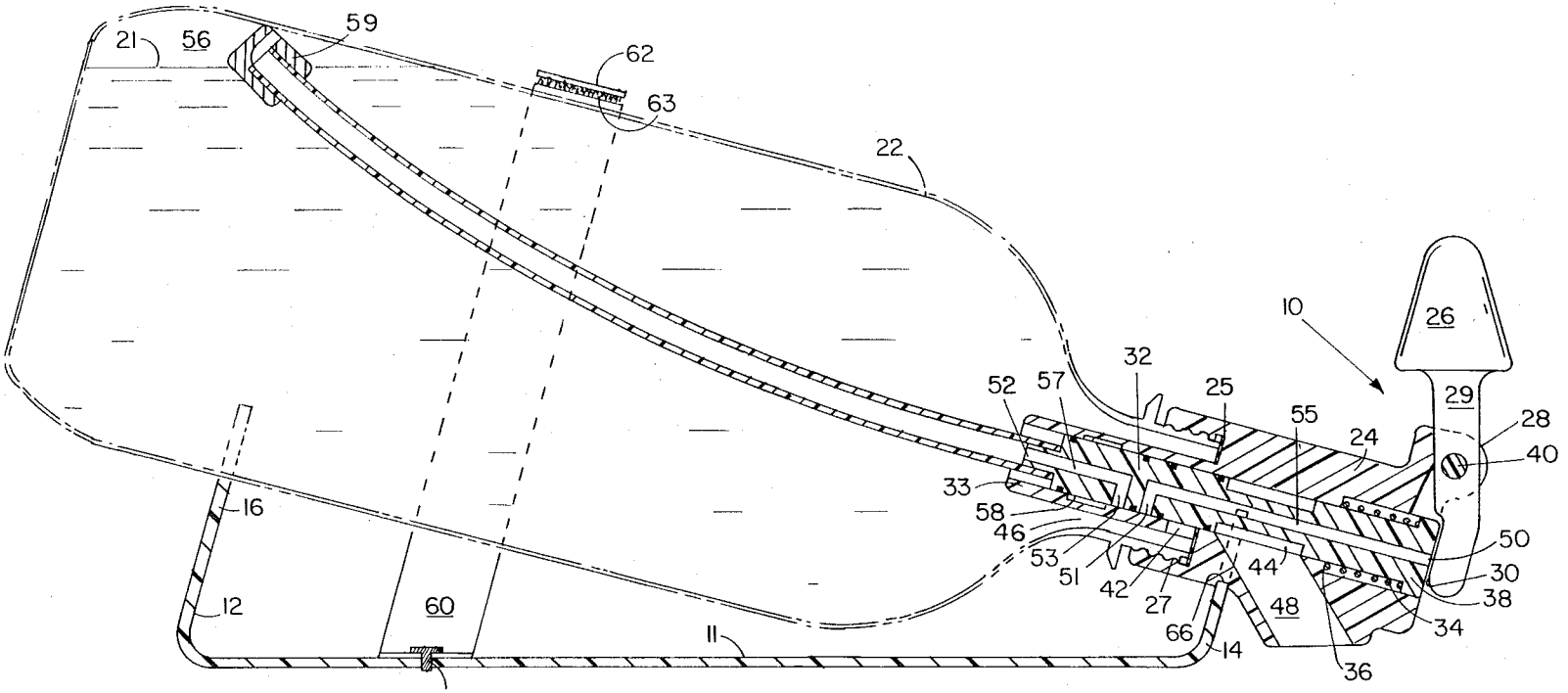
FIG. 3 is a longitudinal section of the apparatus of the present invention, taken along a line 3—3 in FIG. 1.
Figure 4:
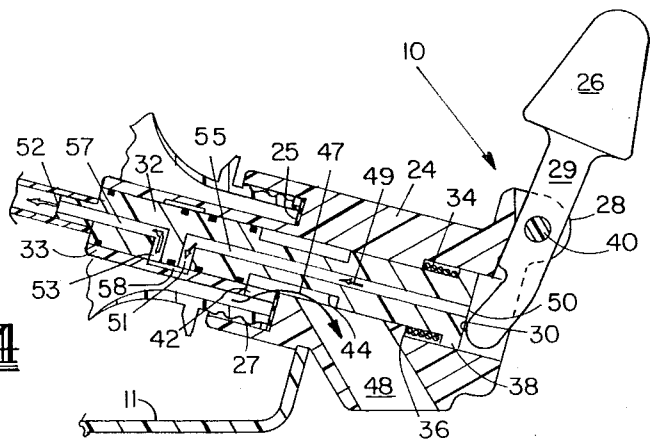
FIG. 4 is an enlarged longitudinal section of a portion of the apparatus of FIG. 1 taken along a line 3—3 in FIG. 1, shown in an open position permitting passage of air and liquid.
Figure 5:
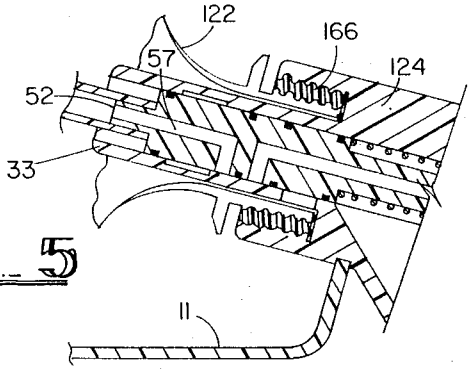
FIG. 5 is an enlarged longitudinal section of a portion of an alternate embodiment of an apparatus constructed according to the teachings of the present invention.

FIGS. 3, 4, and 5 show in longitudinal section the cylindrical spool 32 slidably received within the axially extending bore 33 of housing 24. The spool 32 is selectively positionable in a first, closed position, shown in FIGS. 3 and 5, or a second, open position, shown in FIG. 4. Apparatus 10 is provided with means for biasing spool 32 towards the first, closed position in the form of the weight of fluid 21 contained within bottle 22, the carbonation from carbonated liquids within a bottle 22, and the gravitational force exerted on spool 32. In a presently preferred embodiment, the fluid dispensing apparatus 10 is also provided with a spring 34 for biasing the spool 32 toward the first closed position.

Spring 34 is captured between shoulder 36 of axially extending bore 33 and flange 38 of spool 32. Spring 34 concentrically surrounds spool 32, and biases spool 32 toward the first closed position. An annular groove 44 in spool 32 is shown in FIGS. 3, 4 and 5. An inlet port 42 through the portion of the wall of housing 24 which is contained within bottle 22 when housing 24 releasably engages the mouth of bottle 22 is continuous with axially extending bore 33. A spout 48 is continuous with axially extending bore 33 and extends through the wall of housing 24 in that portion of the housing 24 outside of bottle 22.

Spool 32 is provided with two passageways 55 and 57 therethrough, shown in FIGS. 3, 4, and 5. First passageway 55 has a first opening 50 at the first end of the spool 38 and a second opening 51 in the side wall of spool 32. Second passageway 57 has a first opening 52 at the second end of spool 32 and a second opening 53 in the side wall of spool 32 in close proximity to the second opening 51 of first passageway 55.

Referring to FIG. 4, there is an annular recess 58 in the axially extending bore 33 through housing 24 whereby the first passageway 55 and the second passageway 51 and the annular recess 58 are continuous and the inlet port 42, spout 48 and annular groove 44 are continuous when the spool 32 is in the second open position. Spool 32 can be selectively positioned in the second open position shown in FIG. 4 by the exertion of pressure on spool 32 against the biasing force of spring 34 and the gravitational forces and pressures from within bottle 22. This pressure can be exerted directly, by pushing on flange 38 of spool 32, or it can be exerted by grasping handle 26 which is pivotally mounted to extension tab 28 of housing 24 on pin 40, and pulling downward upon handle 26. This pivotal movement causes the surface 30 of the lever arm 29 to act as a bearing surface to exert pressure against flange 38. Sufficient compression of spring 34 permits spool 32 to be selectively positioned in the second, open position shown in FIG. 4.

In this second, open position, fluid flows from interior fluid space 46 within bottle 22, through inlet port 42, annular groove 44, and spout 48, thus passing from the interior of bottle 22 to the exterior of bottle 22 through housing 24 as shown by arrow 47. At the same time, air flows from exterior air space 54 through passageway 55, annular recess 58, and passageway 57 to air inlet tube 63 as shown by arrows 49. Air inlet tube 63 is integral with spool 32 at the second end thereof, and permits passage of air through air inlet tube 63 to the interior air space 56 of bottle 22.

In a presently preferred embodiment of the invention, the air inlet tube 63 is constructed of light, flexible tubing. Air inlet tube 63 is provided with a float 59 which allows the end of air inlet tube 63 to float to the surface of the liquid 21 within plastic beverage bottle 22.

Referring to FIGS. 1, 2, 3, and 5, means is provided for securing bottle 22 in place on support stand 12 in the form of strap 60 integrally attached to the bottom 11 of support stand 12 by a rivet 61, or other suitable securing means. Strap 60 is preferably constructed of fabric or plastic material having "VELCRO" hooks 62 and loops 64 at the ends thereof. In a presently preferred embodiment, stand 12 is constructed of molded plastic, and strap 60 is adjustable within a range of circumference sufficient to encompass a two-, three-, or four-liter plastic beverage bottle.

Support stand 12 has opposing ends 14 and 16 extending upwardly at an angle from the horizontal. End 14 does not extend upwardly as far as end 16 so that when a bottle is placed upon support stand 12, the mouth portion rests securely on end 14 and bottle 22 is tilted downwardly to facilitate fluid flow. Each end 14 and 16 has a semicircular curved recess 18 for resting a bottle 22 thereon. Housing 24 is provided with a notch 66 which engages the end 14 of support stand 12 for secure placement of bottle 22 upon the support stand 12.

Referring to FIG. 5, an alternate embodiment of the present invention is shown. Adaptor 166 is threaded upon the mouth of bottle 122. Housing 124 is threaded over both adapter 166 and the mouth of bottle 122. This alternate embodiment permits the apparatus of the present invention to be used to dispense beverages from plastic beverage bottles of smaller size as well as those of larger size.

To use the present invention, housing 24 is first threaded about the mouth of bottle 22. Gasket 25 seals housing 24 tightly in connection with the mouth of bottle 22. Bottle 22 is then placed upon stand 12, to rest within the recesses 18. Notch 66 in housing 24 engages the semicircular curved portion 18 of wall 14 of support stand 12 so that bottle 22 will not shift within stand 12. Strap 60 is then secured firmly about bottle 22.

The apparatus 10 of the present invention can be stored on a refrigerator shelf or placed on a counter top or picnic table for serving. Bottle 22 can also be cooled using ice or a chemical ice sleeve (not shown) if desired.

To dispense a beverage from bottle 22, a cup (not shown) is held below the interior of dispensing spout 48. Handle 26 is pulled downwardly toward the dispensing spout 48, compressing spring 34 sufficiently to effect the connection of interior fluid space 46 with spout 48 through inlet port 42 and annular groove 44. As the beverage 21 flows out of bottle 22 and through spout 48, air is also drawn into air space 56 of bottle 22 through first opening 50, first and second passageways 55 and 57, annular recess 58, and air inlet tube 52 at the same time. Simultaneous opening of both fluid and air passageways equalizes internal and external air pressure so that the beverage 21 flows freely out of bottle 22. In the case of a plastic bottle, equalization of interior and exterior pressures prevents the walls of bottle 22 from collapsing.

Although the invention has been described in conjunction with the foregoing specific embodiment, other alternatives, variations, and modifications will be apparent to those of ordinary skill in the art. Those alternatives, variations, and modifications are intended to fall within the spirit and scope of the appended claims.

I claim:

1. An apparatus for dispensing fluids from a bottle comprising:

a housing having an axially extending bore therethrough and means for releasably closing a bottle containing a fluid therein;

a cylindrical spool slidably received within the axially extending bore of said housing and selectively positionable in a first closed position or a second open position;

means biasing said spool toward said first closed position;

an annular groove in said spool;

an inlet port through the wall of said housing contained within the bottle and continuous with the axially extending bore;

a spout through the wall of said housing outside of the bottle and continuous with the axially extending bore;

a first passageway having a first opening at the first end of said spool and a second opening in the side wall of said spool;

a second passageway having a first opening at the second end of said spool and a second opening in the side wall of said spool in close proximity to the second opening of said first passageway; and an annular recess in the axially extending bore through said housing whereby said first and second passageways and the annular recess are continuous and the inlet port, spout and annular groove are continuous when said spool is in said second open position.

2. The apparatus of claim 1 wherein fluid flows through the inlet port, annular groove, and spout.

3. The apparatus of claim 1 wherein air flows through said first and second passageways and the annular recess.

4. The apparatus of claim 1 wherein said bias means comprises a spring.

5. The apparatus of claim 4 wherein said spring is captured between a flange on said spool and a shoulder on said axial bore.

6. The apparatus of claim 1 further comprising a lever arm pivotally mounted to said housing having a bearing surface for engaging the first end of said spool.

7. The apparatus of claim 1 additionally comprising means for tilting the bottle.

8. The apparatus of claim 7 wherein said tilting means comprises a support stand.

9. The apparatus of claim 8 wherein said support stand is provided with means for retaining a bottle therein.

10. The apparatus of claim 9 wherein said bottle retaining means comprises a strap attached to said support stand.

11. The apparatus of claim 8 wherein said housing is provided with means for engaging said support stand.

12. The apparatus of claim 3 additionally comprising an air tube continuous with the second passageway of said spool, whereby air passes through said first and second passageways, the annular recess, and said air tube into an air space within the bottle.

13. The apparatus of claim 12 additionally comprising a float integrally attached to the end of said air tube.

14. The apparatus of claim 1 additionally comprising an adaptor whereby said housing releasably closes bottles of differing diameters.

15. The apparatus of claim 1 wherein said spool is provided with means for sealing said spool against said axial bore.

16. The apparatus of claim 15 wherein said sealing means comprises an O-ring.

17. An apparatus for dispensing fluids from a bottle comprising:

a bottle containing a fluid therein;

a housing having an axially extending bore therethrough and means for releasably closing said bottle;

a cylindrical spool slidably received within the axially extending bore of said housing and selectively positionable in a first closed position or a second open position;

a spring for biasing said spool toward said first closed position;

an annular groove in said spool;

an inlet port through the portion of the wall of said housing contained within said bottle, said inlet port being continuous with the axially extending bore;

a spout through the portion of the wall of said housing outside of said bottle, said inlet port being continuous with the axially extending bore;

a first passageway having a first opening at the first end of said spool and a second opening in the side wall of said spool;

a second passageway having a first opening at the second end of said spool and a second opening in the side wall of said spool in close proximity to the second opening of said first passageway; and an annular recess in the axially extending bore through said housing whereby said first and second passageways and the annular recess are continuous and the inlet port, spout, and annular groove are continuous when said spool is in said second open position.

18. The apparatus of claim 17 wherein fluid flows from said bottle through the inlet port, annular groove, and spout.

19. The apparatus of claim 17 wherein said spring is captured between a flange on said spool and a shoulder in the axial bore.

20. The apparatus of claim 17 further comprising a lever arm pivotally mounted to said housing and a bearing surface for engaging the first end of said spool.

21. The apparatus of claim 17 additionally comprising means for tilting the bottle.

22. The apparatus of claim 17 wherein said tilting means comprises a support stand.

23. The apparatus of claim 22 wherein said support stand is provided with means for retaining a bottle therein.

24. The apparatus of claim 17 wherein said housing is provided with means for engaging said support stand.

25. The apparatus of claim 17 additionally comprising an air tube continuous with the second passageway of said spool.

26. The apparatus of claim 25 additionally comprising a float integrally attached to the end of said air tube.

27. The apparatus of claim 17 additionally comprising an adaptor whereby said housing releasably closes bottles of differing diameters.

* * * * *